US005505249A

United States Patent [19]

Scheurecker et al.

[11] Patent Number: 5,505,249

[45] Date of Patent: Apr. 9, 1996

[54] CONTINUOUS CASTING MOLD

[75] Inventors: Werner Scheurecker, Linz; Helmut Eidinger, Schönering; Richard Kasmader, Frankenmarkt; Josef Guttenbrunner, Sierning, all of Austria

[73] Assignee: Voest-Alpine Industrieanlagenbau GmbH, Austria

[21] Appl. No.: 358,326

[22] Filed: Dec. 19, 1994

[30] Foreign Application Priority Data

Dec. 20, 1993 [AT] Austria ..... 2571/93
Jul. 7, 1994 [AT] Austria ..... 1344/94

[51] Int. Cl.[6] ..... B22D 11/00; B22D 11/04

[52] U.S. Cl. ..... 164/418; 164/416

[58] Field of Search ..... 164/418, 459, 164/439, 490, 478, 416

[56] References Cited

U.S. PATENT DOCUMENTS 4,612,970 9/1986 Grothe ..... 164/478
5,297,612 3/1994 Korpela et al. ..... 164/452
5,350,005 9/1994 Sorimachi et al. ..... 164/416

*Primary Examiner*—P. Austin Bradley
*Assistant Examiner*—I.-H. Lin
*Attorney, Agent, or Firm*—Ostrolenk, Faber, Gerb & Soffen

[57] ABSTRACT

A continuous casting mold comprising an oscillating supporting structure including side walls defining a mold cavity, together with the supporting structure, is supported on a lifting table oscillated by an oscillation drive and guided in the oscillation direction by a guiding device. In order to keep the oscillating masses as small as possible and to improve the space conditions below the mold as well as to ensure easy repair, the lifting table is formed by at least two oscillating beams arranged at a distance leaving free the horizontal dimensions of the mold cavity and bridged by the supporting structure including the side walls.

27 Claims, 3 Drawing Sheets

CONTINUOUS CASTING MOLD

BACKGROUND OF THE INVENTION

The invention relates to a continuous casting mold comprising an oscillating supporting structure including side walls defining a mold cavity and supported on a lifting table oscillating by means of an oscillation drive and guided in the oscillation direction by a guiding means.

For casting strands having a slab cross sectional formats it is known to support plate-shaped mold side walls defining a mold cavity and each reinforced by a supporting structure on a water box surrounding the side walls in a frame-like manner by means of these supporting structures and to mount the water box on a likewise frame-shaped lifting table (AT-B - 343.838, AT-B - 335.242 and AT-B - 359.673). In doing so, both the water box and the lifting table are designed as supporting frames, the lifting table being set in vertical oscillations by an oscillation drive during casting, and hence also the mold side walls via the water box.

This known construction involves the disadvantage that a relatively large mass must be set in oscillation movements. Moreover, both the flame-like water box and the frame-shaped lifting table require much space, offer poor accessibility to strand guide structures arranged below the continuous casting mold and render feasible the provision of auxiliary devices, such as electromagnetic starers, etc. only with difficulty.

From EP-B - 0 233 796 and from BP-A - 0 417 504 it is known to do without a water box with a continuous casting mold and to support the mold side walls with their supporting structures directly on a flame-shaped lifting table.

A continuous casting mold without water box does have slightly more stable side walls than a comparable mold incorporating a water box, yet its advantages predominate, which are to be seen in that its structure is more compact and simple because of the presence of fewer structural parts, that the overall structural weight and hence its production costs are substantially lower, that the accessibility for maintenance and adjustment works is enhanced and that a mold replacement is more simple and quick to carry out.

With the continuous casting plate mold without water box known from EP-B - 0 233 796, the side walls that are designed as broad side walls, with their supporting structures, are directly mounted on a frame-shaped lifting table capable of being set in vertical lifting and lowering movements by means of an oscillation drive. The narrow side walls inserted between the broad side walls each are supported on the lifting table via a special device that serves to adjust the position of the narrow side walls. Such devices are pivotably fastened to the lifting table in a manner that they can be brought into a position outside of the frame-shaped lifting table as seen from above, for the purpose of clearing the opening of the lifting table.

This construction involves the disadvantage that a heavy and sturdy frame-shaped lifting table is required and that the side walls of the plate mold cannot readily be removed from the lifting table as a unit and replaced with a new unit. For, with this known solution each of the broad side walls and each of the narrow side walls must be lifted off the lifting table separately. This is cumbersome and requires relatively much time.

With the continuous casting mold without water box known from EP-A - 0 417 504, a device for adjusting the narrow side walls again is arranged on the lifting table, i.e., is rigidly fastened thereto. The broad side walls are supported on this device and, thus, are mounted on the lifting table with this device being interposed. The two broad side walls are adjustable relative to the narrow side walls in a manner that this construction does not offer any possibility to configure one of the broad side walls as a fixed side. Even with this construction, the lifting table must be designed to be particularly rigid and, consequently, sturdy and expensive.

SUMMARY OF THE INVENTION

The invention aims at avoiding these disadvantages and difficulties and has as its object to provide a continuous casting plate mold of the initially defined kind, which is designed in a substantially less material-requiring manner than according to the prior art, yet, nevertheless, has all the advantages offered by molds comprising sturdy and heavy frame-shaped lifting tables and frame-like water boxes, such as, for instance, the simple removability and installability of the mold side walls for the purpose of a mold conversion as well as the high rigidity of the structure and precise oscillation. Furthermore, the mold according to the invention is to be readily repaired if, for instance, the oscillation drive or a guide for the lifting table have become defect. It is a particular aim of the invention to strongly reduce the masses to be moved by the oscillation drive as compared to conventional continuous casting molds and to improve the space conditions below the mold, in particular, to obtain good acessibility to the continuous casting plant below the continuous casting mold.

In accordance with the invention, this object is achieved in that the lifting table is comprised of at least two oscillating beams arranged at a distance leaving free the horizontal dimensions of the mold cavity, which beams are bridged by the supporting structure including the side walls.

Thereby, the supporting structure including the side walls of the continuous casting mold takes over the stability requirements. As is the case with a bridge structure, this supporting structure constitutes a self-supporting carrying framework such that the lifting table only functions as a bearing means for this carrying framework in a manner similar to bridge bearings. Thus, the lifting table may be minimized in terms of mass; it merely transmits the oscillation movement from the oscillation drive to the supporting structure including the side walls and need not absorb any other forces. The beams forming the lifting table may be designed to be small and to require little space. Since there are no frame elements, good accessibility both to the oscillation means and to the guiding means for these beams is offered. With the continuous casting mold according to the invention, the provision of auxiliary devices, such as electromagnetic stirrers, measuring means, etc., may be realized in a substantially simpler manner.

Preferably, each of the beams is separately supported relative to a stationarily supported carrying structure by means of an oscillation means and is separately guided in the oscillation direction by a guiding means.

Particularly effective saving of mass for the beams forming the lifting table may be achieved if the point of contact of the oscillation means each is provided in approximately vertical alignment with the support on the beams of the lifting table, of the supporting structure including the side walls. Thereby, bending moments on the beams caused by the weight of the supporting structure including the side walls are largely avoided and the beams can be designed particularly light-weight and small.

A particularly simple way of mounting and dismounting the continuous casting mold as well as parts of the same results if the stationary carrying structure for each of the beams, together with the guiding means and the oscillation means, forms a structural unit to be removed and installed together with the beam.

Preferably, each of the beams is supported on the stationary carrying structure by means of at least two spring bands arranged at a vertical distance from each other, which spring bands suitably are arranged symmetrical with respect to the vertical plane of symmetry of the continuous casting mold such that no bearings whatsoever will be required for guidance any longer. The provision of spring bands for supporting lifting tables of molds is known per se (EP-B - 0 032 116, AT-B - 383.520, AT-B - 383.521), yet only for one-part frame-shaped heavy lifting tables.

Preferably, the oscillation means are comprised of hydraulic cylinders, whereby it is possible to do without elements moving at each another, such as eccentrics, cam shafts and supports engaging thereat, etc., which are subject to heavy wear, thermal influences and risks of contamination in the rough metallurgical operation.

Preferably, the hydraulic cylinders are supported both on the stationary carrying structure and on the beams of the lifting table, each rigidly in the oscillation direction and elastically transverse to the oscillation direction, balancing out of thermal expansions etc. of the supporting structure including the side walls of the continuous casting mold, thus, being feasible.

According to a preferred embodiment, the elastic support is provided by spring rods or bars, respectively, extending in the oscillation direction.

Another preferred embodiment is characterized in that the elastic support for each of the hydraulic cylinders is formed by a spring bar arranged in the axis of the hydraulic cylinder and provided with at least one peripheral groove for a lateral movement in the elastic range of the spring bar.

A particularly space-saving construction is characterized in that the spring bands are arranged laterally of the beams of the lifting table and the oscillation means is arranged below each beam, wherein the beams of the lifting table advantageously have L-shaped vertical cross sections and wherein the supporting structure rests on the approximately horizontally oriented leg of the "L", the latter bearing against the oscillation means, and each of the guiding means directly contacts the approximately vertically oriented part of the "L".

A particularly light-weight and simple construction of the continuous casting mold is characterized in that the supporting structure including the side walls is directly supported on the beams of the lifting table, i.e., without interposition of a water box.

According to a preferred embodiment, a continuous casting mold without water box in accordance with the invention is characterized in that the continuous casting mold is designed as a plate mold and comprises parallel broad side walls and narrow side walls capable of being clamped between these broad side walls by a clamping means, wherein one of the two broad side walls is provided with crossheads embracing the two narrow side walls, the broad side wall opposite this broad said wall is supported on the crossheads and the crossheads are carried by the synchronously oscillating beams.

With the continuous casting mold without water box known from EP-B - 0 233 796, the broad side walls are displaceable relative to the lifting table for the purpose of clamping the narrow side walls, to which end displacement means especially arranged on the lifting table are provided. In order to be able to clear the lifting table completely, one is forced to remove these displacement means also separately. In doing so, it is disadvantageous that the clamping and straddling forces as well as the forces applied in format adjusting are transmitted onto the lifting table. This involves the danger of the lifting table being deformed and, thus, of the mold being expanded. Hence, a particularly expensive and sturdy lifting table is required. Another disadvantage is to be seen in that none of the broad side walls serves as a fixed side, but that both of the broad side walls must be adjusted relative to the narrow side walls. If the strand casting format is to be altered in terms of thickness, both of the broad side walls will have to assume new positions relative to the lifting table and hence also new positions relative to the strand guide provided below the lifting table. This implies cumbersome adjustment works.

These disadvantages can be avoided by the above-described special embodiment of the continuous casting mold according to the invention, because the first side wall that is provided with the crossheads constitutes the so-called fixed side and is rigidly and immovably supported on the beams forming the lifting table.

Preferably, the free ends of the crossheads, in accordance with the invention, are equipped with consoles extending in the direction towards the second one of the broad side walls, adjustment drives for the narrow side walls suitably each being arranged on the crossheads.

To avoid moments acting on the beams and extensive loads exerted on the guiding means, the oscillation means suitably each are arranged vertically below the crossheads.

It is a particular object of the invention to provide a continuous casting plate mold of the initially defined kind, which can be removed from the lifting table in a single operation as a whole, i.e., while taking away all of the side walls and, preferably, all of the auxiliary devices (such as clamping mechanisms, adjusting mechanisms, etc.) such that a mold exchange, for instance, in case of a failure or with a view to changing format can be realized in a simple manner and within a very short span of time. With the continuous casting plate mold it is to be feasible, in particular, to additionally configure one of the first side walls as a fixed side in a simple manner. In addition, the lifting table is to be designable with a simple and light-weight structure and is to offer a completely free access to plant parts arranged below the lifting table after removal of the continuous casting mold.

This object is achieved in that the continuous casting mold is designed as a plate mold comprising parallel first side walls and second side walls capable of being clamped between these first side walls by a clamping means, wherein both of the first side walls are supported on the beams by their end portions and both of the two second side walls are supported on at least one of the first side walls and on the lifting table via the same.

A particularly suitable embodiment is characterized in that one of the first side walls in both end regions is provided with a cantilever beam each carrying one of the second side walls, this first side wall being fastened to the lifting table as a fixed side wall.

The continuous casting plate mold according to the invention offers the opportunity of forming the clamping means by tie connection means supported on both of the first side walls, such as a pressure medium cylinder. This enables clamping of the narrow side walls without having to provide therefor a special device on the lifting table, which means that the lifting table can be kept clear from such device, the clamping means being removed from the lifting table together with the continuous casting mold when removing the latter.

Preferably, the two first side walls are guided on each other via the cantilever beams, wherein suitably both the cantilever beam and the first side wall to be guided on the cantilever beam are guided on each other by contiguous guiding surfaces. Hence results a particularly compact structural unit of the continuous casting plate mold.

Preferably, the cantilever beams carry position adjusting means for the second side walls.

Advantageously, the supply of the first and second side walls is effected via plug connections arranged, by one part, on the lifting table and, by counter pieces, on the end regions of the first side walls, and for the second side walls, on the cantilever beams.

BRIEF DESCRIPTION OF THE DRAWINGS

In the following, the invention will be explained in more detail by way of several exemplary embodiments and with reference to the accompanying drawing, wherein:

FIGS. 7 to 9 each merely illustrating the left-hand half of a plate mold designed symmetrical with respect to its median line.

DESCRIPTION OF THE PREFERRED EMBODIMENTS

Figure 3:
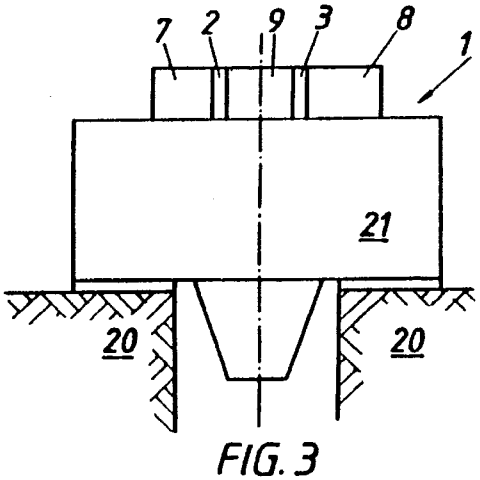
FIG. 3 is a side view in the direction of arrow III of FIG. 1.

A continuous casting mold 1 comprises an open-ended mold cavity 6, which is laterally enclosed by side walls 2, 3, 4, 5 formed of copper plates and whose cross sectional format is dimensioned for casting preferably thin slabs. Each of the side walls 2 to 5, i.e., both the narrow side walls 4, 5 and the broad side walls 2, 3, on its back is supported by supporting walls 7, 8, 9, 10 preventing deformations of the copper plates 2 to 5, through which supporting walls also the supply and discharge of the coolant cooling the copper plates 2 to 5 is accomplished.

Figure 2:
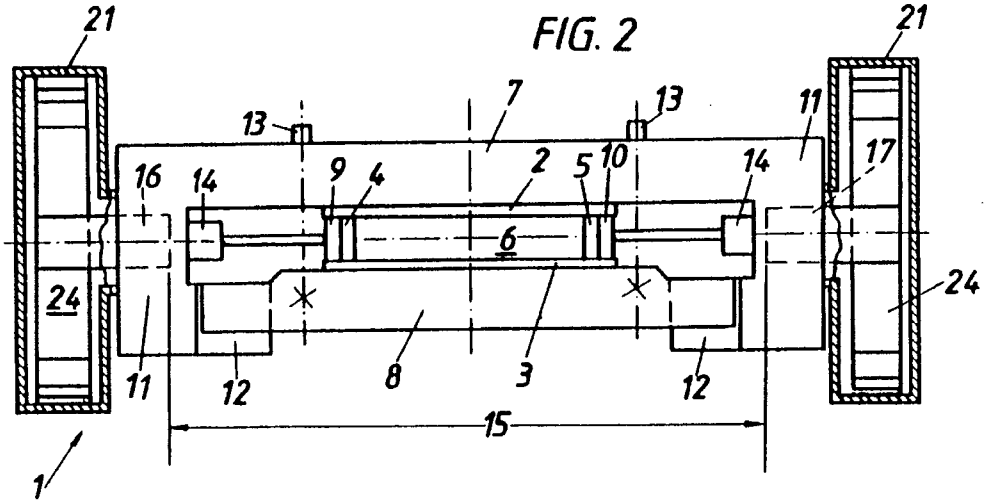
FIG. 2 is a likewise partially sectioned view in the direction of arrow II—II of FIG. 1.

As is apparent, in particular, from FIG. 2, one of the supporting walls, i.e., wall 7, for one of the broad side walls, i.e., wall 2, viewed in ground plan, is designed to have a C-shaped cross section and to surround the mold cavity 6 laterally, i.e., it comprises crossheads 11 that are oriented parallel to the narrow side walls 4, 5 and on which the oppositely arranged broad side wall 3 is supported by its pertaining supporting wall 8 via console-like ends 12 again oriented inwardly. The narrow side walls 4, 5 are firmly clamped between the broad side walls 2, 3 by schematically indicated clamping means 13. Adjustment drives 14 that serve to adjust the format of the narrow side walls 4, 5, together with the coolant supply and discharge organs, are supported on the crossheads 11 of the supporting wall 7 of the first broad side wall 2 forming the so-called fixed side. The side walls 2 to 5 defining the mold cavity 6, together with the supporting walls 7 to 10, constitute a compact structural unit capable of being readily removed from, and installed into, the continuous casting plant and of being readily exchanged for a structural unit having a different cross section (inside width) of the mold cavity. The supporting walls 7 to 10 in this case are designed as a supporting structure carrying the side walls 2 to 5.

Figure 1:
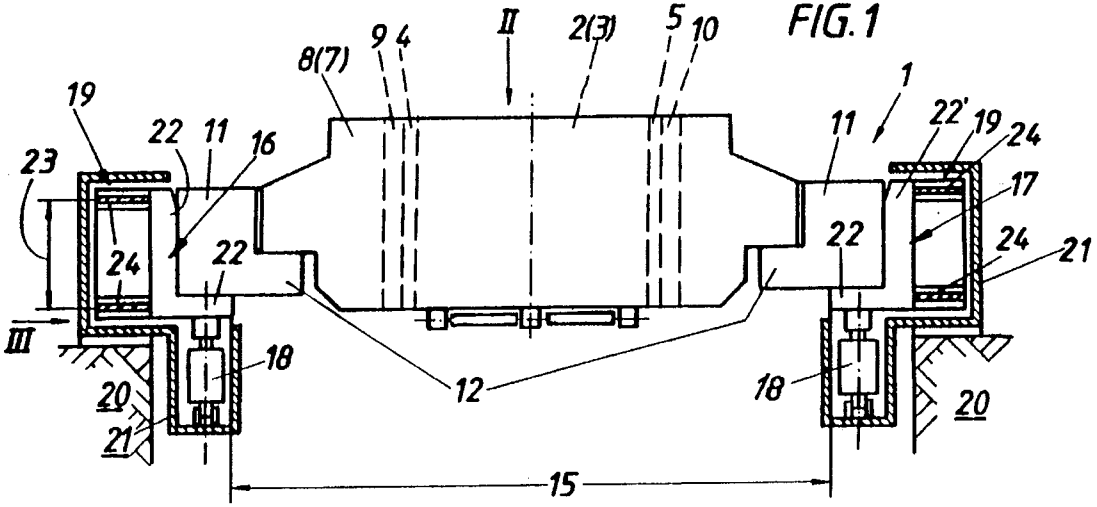
FIG. 1 is a partially vertically sectioned side view of a continuous casting mold for slabs in schematic illustration.

As can be taken, in particular, from FIG. 1, this compact structural unit formed by the side walls 2 to 5 and by the supporting walls 7 to 10, by its crossheads 11, rests on two beams 16, 17 arranged at a distance 15 from each other and forming the lifting table. Each of these beams 16, 17, via an oscillation means 18 and a guiding means 19, is supported on a carrying structure 21 stationarily arranged on the base 20.

In side view (cf. FIG. 1), the beams 16, 17 are designed to be L-shaped, the crossheads 11 each resting on the horizontally extending portion 22 of each L-shaped beam 16, 17. Below the horizontal portion 22 of each L-shaped beam 16, 17, the oscillation means 18, which is formed by a pressure medium cylinder, such as a hydraulic cylinder, is arranged in vertical alignment to this bearing.

For the purpose of precisely guiding the beams 16, 17 of the lifting table, the beams 16, 17 each are guided relative to the stationary carrying structure 21 by two spring bands 24 superimposed at a vertical distance 23 and extending approximately parallel to the narrow side walls 4, 5 of the continuous casting mold 1, wherein the beams 16, 17, by their vertically oriented portions 22', are fastened centrally of the spring bands and the ends of the spring bands 24 are rigidly fastened to the carrying structure 21. This enables the beams 16, 17 to oscillate in the strictly vertical direction, i.e., the oscillation direction, upon actuation of the pressure medium cylinders 18.

Figure 4:
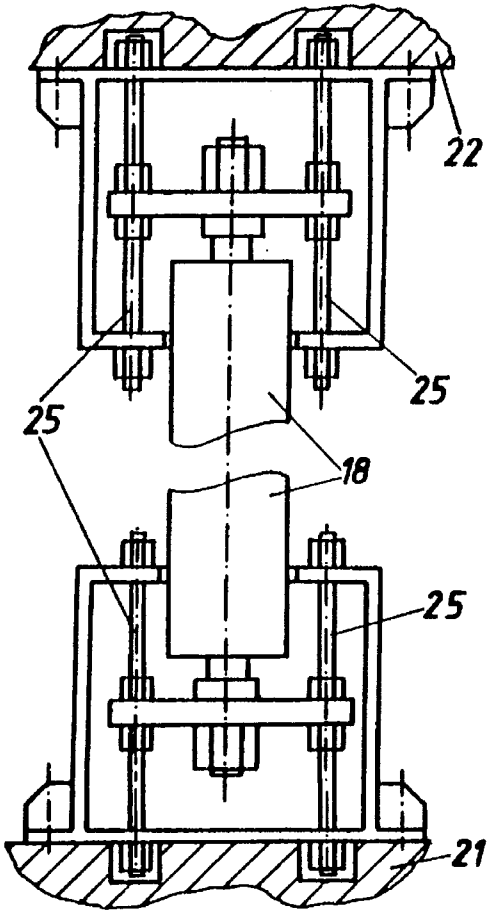

In order to balance out deformations caused, for instance, by thermal influences, or mounting inaccuracies, the support of the oscillation means 18 is realized under admission of a lateral movability of the beams 16, 17, i.e., in a direction transverse to the oscillation direction, wherein, according to the embodiment represented in FIG. 4, the support of the hydraulic cylinders 18 on the beams 16, 17 of the lifting table and on the stationary carrying structure 21, respectively, is effected via spring rods 25 extending in the oscillation direction and allowing for a certain deformation within the elastic range in a direction perpendicular to their longitudinal extension.

Figure 5:
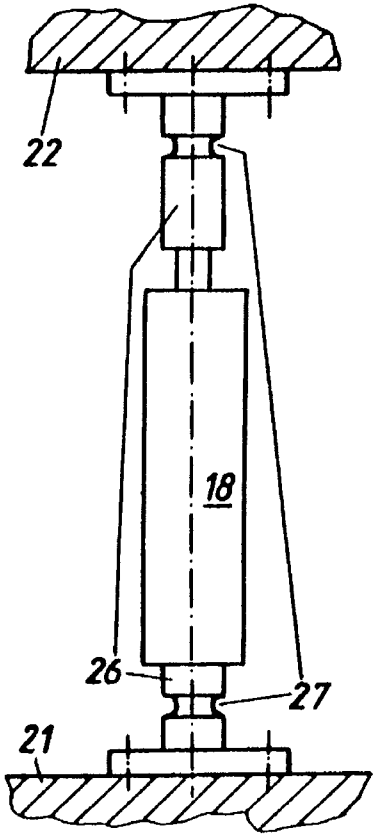

According to the embodiment illustrated in FIG. 5, the support of the hydraulic cylinders 18 on both ends is effected via one spring bar 26 each, which is provided with a peripheral groove 27 in order to allow for a certain lateral movement.

Figure 6:
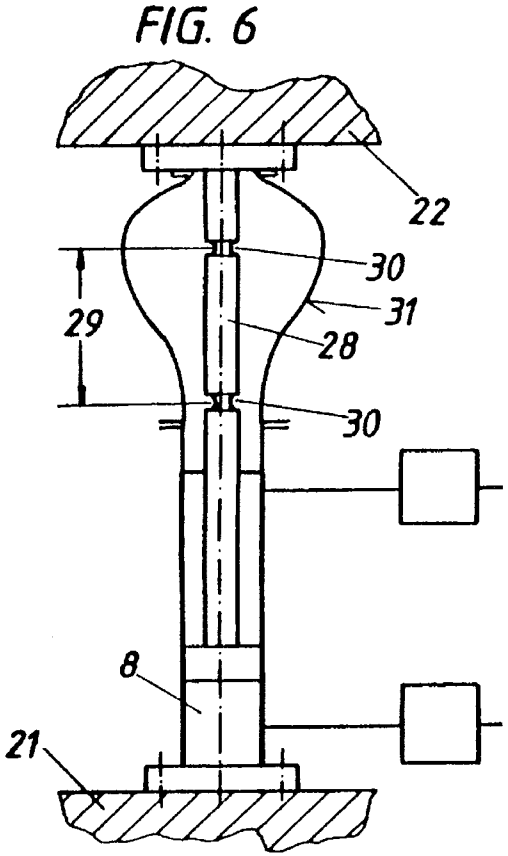
FIGS. 4, 5 and 6 each represent a different type of the support provided for the oscillation means.

According to the embodiment depicted in FIG. 6, each hydraulic cylinder 18 on one of its ends is mounted in a rigid and completely immovable manner and on its other end is supported via a spring bar 28 including two annular peripheral grooves 30 arranged at a distance 29 from each other, thus likewise offering a lateral movability without impairing the precise running of the piston of the hydraulic cylinder 18 within the cylinder. To protect the oscillation means 18, the latter is provided with a protective cap 3 1 that is elastically deformable at least partially.

The stationarily mounted carrying structure 2 1, together with the beams 16, 17 of the lifting table, the spring bands 24 and the oscillation means 18, each likewise constitutes a structural unit capable of being readily exchanged such that in case of a defect repair is feasible very rapidly by exchanging the defect part, the continuous casting mold 1 being ready for re-use within a short span of time.

The invention is not limited to the exemplary embodiment illustrated in the drawing, but may be modified in various aspects. It is, for instance, possible to replace the oscillation drive comprised of the hydraulic cylinders 18 with any other construction, for instance, with eccentrics, etc. Also, it is possible to form the guiding means for the beams 16, 17 of the lifting table, for instance, by conventional guiding means provided with rollers and guide ledges.

Instead of a straight open-ended mold cavity 6 defined by the side walls 2 to 5, a curved open-ended mold cavity may also be provided. In such a case, the oscillation means and the guiding means are designed in a manner that the central axis of the continuous casting mold 1 moves along a circular arc during oscillation.

The configuration of the beams 16, 17 forming the lifting table likewise may be varied, although the L-shaped configuration of the beams 16, 17 offers particular advantages, since moments that might be caused by the weight of the continuous casting mold 1 are avoidable in a structurally simple manner. Thus, the beams 16, 17 are practically free from moments such that they may be designed to be particularly lightweight and small. The number of beams 16, 17 forming the lifting table also may be chosen freely. What is essential is that the beams 16, 17 are arranged so as to clear the mold cavity and the space below the same and that the supporting structure 7 to 10 including the mold side walls 2 to 5 spans these beams 16, 17 in the manner of the supporting flamework of a bridge.

Figure 9:
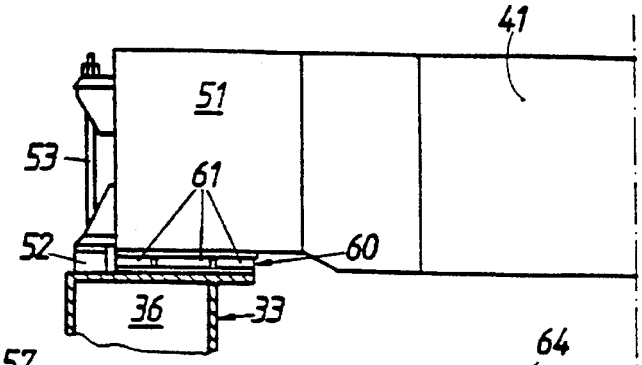
FIGS. 7 to 9 are more detailed representations of a further embodiment, FIG. 7 being a schematic illustration of a central vertical section parallel to the first side walls of a continuous casting plate mold, FIG. 8 being a top view on the continuous casting mold and FIG. 9 being a sectional illustration along line IX—IX of FIG. 8.
Figure 7:
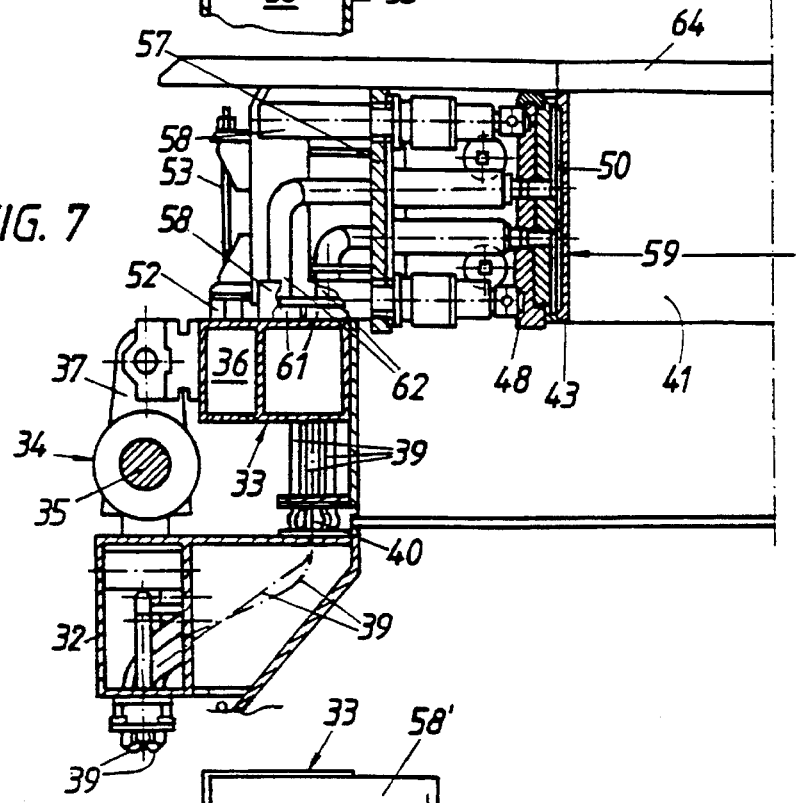
Figure 8:
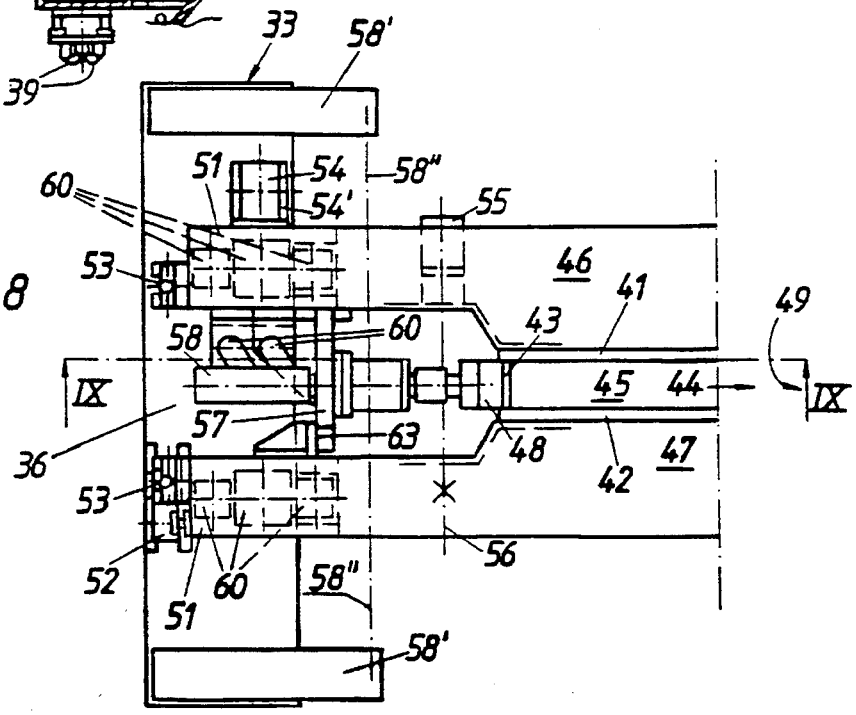

According to the embodiment illustrated in FIGS. 7 to 9, a lifting table 33 is supported on a carrying structure formed by bearings 32 and stationarily arranged on a base, via an oscillation drive 34. The oscillation drive 34 comprises eccentric shafts 35 extending along the beams of the lifting table, which are configured as box sections 36, setting the lifting table in a vertical lifting and lowering movement via brackets 37 hinged to the lifting table 33. In order to guide the lifting table 33 strictly in the vertical direction, guide elements (not illustrated) are provided between the lifting table 33 and the stationary bearings 32. The lifting table 33 is designed to be open, i.e., is formed by the box sections 36 alone. Care is to be taken that the box sections 36 of the lifting table 33 will oscillate synchronously.

Supply ducts 39, such as, for instance, coolant supply and discharge ducts, are led to the lifting table 33 via the stationary bearings 32 by elastic connection elements 40 being interposed.

Side walls 41 to 44 of the continuous casting plate mold, which are formed by copper plates, are supported on the lifting table 33 without interposition of a water box. All of the side walls 41 to 44 are configured as individual plates, first side walls 41, 42, in the following denoted as broad side walls, being directly supported on the lifting table 33 and second side walls 43, 44, in the following denoted as narrow side walls, being clampable between the broad side walls 41, 42. The side walls 41 to 44 enclose a cavity 45 intended for casting a strand having slab format. All of the side walls, on their outer sides, are reinforced by a supporting structure comprised of supporting plates 46 to 49, coolant channels 50 each being provided between the copper plates 41 to 44 and the pertaining supporting plates 46 to 49.

The supporting plates 46, 47 of the broad side walls 41, 42, by their end regions 51, extend as far as to above the box sections 36 of the lifting table 33. By these end regions 51, they rest on bearing blocks 52 arranged on the lifting table 33 on its upper side and are clampable against the lifting table 33 by a clamping means designed as a tension rod 53. One of the broad side walls, namely wall 41, is designed as a so-called fixed side wall, i.e., it assumes a precisely defined position relative to the lifting table 33, whereas the opposite broad side wall 42 is displaceable in a direction perpendicular to the fixed side wall 41 and is fixable in different positions. For centering the broad side wall 41 forming the fixed side wall 41, centering elements 54 are provided on the lifting table 33 and counter elements 54' are provided in the end regions 51 of the broad side wall 41.

To carry out a translatory movement of the broad side wall 42, at which the narrow side walls 43, 44 can be clamped between the broad side walls 41, 42 or are released upon straddling, adjustment means 55 provided in the end regions 51 of the fixed side wall, such as, for instance, pressure medium cylinders, serve, which contact the opposite broad side wall 42 by their piston rods 56, drawing the same towards the fixed side wall 41 or moving it away therefrom.

The fixed side wall 41, in its end regions 51 extending over the box sections 36 of the lifting table 33, comprises a cantilever beam 57 each, which is directed to the oppositely arranged broad side wall 42. A narrow side wall 43 or 44, respectively, is each supported on a cantilever beam 57 by means of a spindle drive 58, which serves to adjust the position of a narrow side wall 43 or 44, respectively, to a predetermined strand width 59 and/or to adjust a desired conicity. Electromotors 58' mounted on the lifting table and connected with the spindle drives 58 via articulated shafts 58" in a known manner serve to actuate the spindle drives.

The supply of the broad side walls 41, 42 and of the narrow side walls 43, 44 with coolant is effected via plug connection means 60, one part 61 of which is each arranged on the lifting table 33, namely on its box sections 36, and the respective counter piece 62 of which is each arranged in the end regions 51 of the broad side walls 41, 42 and on the cantilever beam 57 (for the narrow sides 43, 44), respectively. Connection occurs automatically by placing the side walls 41 to 44 on the lifting table 33, thus causing the counter pieces 62 to get into engagement positions with parts 61. The automatic coolant connections on either side may be configured both as rubber compression (pressure) connection means and as plug connection means, preferably as plug connection means on the loose side.

The broad side wall 42 that displaceably supported on the lifting table 33 is guided relative to the fixed side wall 41 via guiding surfaces 63 provided on the cantilever beam 57 as well as in the end regions 51 of the broad side wall 42; upon displacement into the right position, i.e., upon clamping of the narrow side walls 43, 44, it may be clamped against the lifting table 33 by means of the tension rods 53.

The continuous casting plate mold renders feasible the use of a lifting table 33 that is designed to be substantially less sturdy than has been common so far. Since the broad side walls 41, 42 are supported directly on the box sections 36 of the lifting table 33, which means that the flow of force occurs almost linearly from the side walls 41 to 44 of the mold through the lifting table 33 via the oscillation drive 34 towards the stationary bearing 32, the cross section of the box sections 36 of the lifting table 33 may be kept small.

Another substantial advantage of the continuous casting plate mold is to be seen in that, after having released the means 53 clamping the broad side walls 41 and 42 onto the lifting table 33, the side walls 41 to 44 can be lifted off the lifting table 33 all at once, no means whatsoever remaining on the lifting table 33 except for the centering elements 54 for centering the fixed side wall 41 on the lifting table 33 and the relatively expensive electromotors 58'. All of the coolant connection means suitably are configured in a manner that their connection will be ensured automatically when placing the side walls 41 to 44 of the mold on the lifting table 33.

From what has been said above, it follows that a mold exchange, say for the purpose of replacing a defect mold or for the purpose of altering the format, is feasible in a particularly simple manner and within a very short time, wherein a mold cover 64 need not be removed separately, either, because the mold cover 64 rests on the side walls 41 to 44 and is centered via the fixed side wall 41. Hence result short assembly times and a high availability of the continuous casting plate mold.

The structure according to the invention allows for the conversion of an existing continuous casting plant in which, for instance, the displaceability of the narrow side walls 43, 44 has been renounced in the beginning for cost reasons, by exchanging its side walls for side walls 41 to 44 offering such displaceability, no modification whatsoever being required at the lifting table 33.

The embodiment according to FIGS. 7 to 9 may be modified in various aspects. Thus, it is possible to provide a cantilever beam 57 carrying a narrow side wall 43 or 44, respectively, on one of the broad side walls 41 and 42 each.

What we claimed is:

1. In a continuous casting mold arrangement of the type including a continuous casting mold, an oscillating supporting structure for supporting side wall means defining a mold cavity, a lifting table adapted to support said side wall means, an oscillation drive means adapted to set said lifting table in oscillation, and a guiding means adapted to guide said lifting table in the direction of oscillation, the improvement wherein said lifting table is comprised of at least two oscillating beam means arranged at a distance apart horizontally so that said two oscillating bean means are and bridged by said mold cavity and said supporting structure for supporting said side wall means.

2. A continuous casting mold arrangement as set forth in claim 1, wherein said supporting structure including said side wall means is directly supported on said beam means of said lifting table, i.e., without interposition of a water box.

3. A continuous casting mold arrangement as set forth in claim 1, wherein each of said beam means of said lifting table has an L-shaped cross section including an approximately horizontally oriented leg and an approximately vertically oriented leg, and wherein said supporting structure rests on said approximately horizontally oriented leg, said approximately horizontally oriented leg being supported on said oscillation drive means.

4. A continuous casting mold arrangement as set forth in claim 3, wherein each of said guiding means directly contacts said approximately vertically oriented leg.

5. A continuous casting mold arrangement as set forth in claim 1, wherein said oscillation drive means is comprised of a hydraulic cylinder means.

6. A continuous casting mold arrangement as set forth in claim 7, wherein said hydraulic cylinder means is supported both by said stationarily supported carrying structure and by said beam means of said lifting table, each rigidly in the direction of oscillation and each elastically transverse to the direction of oscillation.

7. A continuous casting mold arrangement as set forth in claim 6, further comprising spring bar or spring rod means extending in the direction of oscillation to elastically support said hydraulic cylinder means.

8. A continuous casting mold arrangement as set forth in claim 6, further comprising a spring bar means arranged in the axis of each of said hydraulic cylinder means to elastically support said hydraulic cylinder means, said spring bar means being provided with at least one peripheral groove allowing for a lateral movement within the elastic range of said spring bar means.

9. A continuous casting mold arrangement as set forth in claim 1, wherein said continuous casting mold is designed as a continuous casting plate mold comprising two parallel broad side wall means and two narrow side wall means capable of being clamped between said broad side wall means, a clamping means adapted to clamp said narrow side wall means between said broad side wall means, and crosshead means provided on one of said two broad side wall means so as to embrace both of said narrow side wall means, the other of said two broad side wall means arranged opposite said one of said broad side wall means being supported on said crosshead means and said crosshead means being carried by said beam means oscillating synchronously.

10. A continuous casting mold arrangement as set forth in claim 9, further comprising console means provided on said crosshead means on the free ends thereof and extending in a direction towards the second one of said broad side wall means.

11. A continuous casting mold arrangement as set forth in claim 9, further comprising adjustment means each provided for said narrow side wall means on said crosshead means.

12. A continuous casting mold arrangement as set forth in claim 9, wherein each of said oscillation drive means is arranged vertically below said crosshead means.

13. A continuous casting mold arrangement as set forth in claim 1, further comprising a stationarily supported carrying structure provided for each of said beam means and wherein each of said beam means is supported by its own oscillation drive means and is guided in the direction of oscillation by its own guiding means, relative to said stationarily supported carrying structure.

14. A continuous casting mold arrangement as set forth in claim 13, wherein each of said oscillation drive means is disposed in approximately vertical alignment with a point of contact between said beam means of said lifting table and said supporting structure for supporting said side wall means.

15. A continuous casting mold arrangement as set forth in claim 13, wherein said stationarily supported carrying structure for each one of said beam means, together with the pertaining one of said guiding means and the pertaining one of said oscillation drive means, forms a structural unit capable of being removed and installed together with said beam means.

16. A continuous casting mold arrangement as set forth in claim 13, further comprising at least two spring bands arranged at a vertical distance from each other to support each of said beam means on said stationarily supported carrying structure.

17. A continuous casting mold arrangement as set forth in claim 16, wherein said spring bands are arranged in a manner symmetrical with respect to the vertical plane of symmetry of said continuous casting mold.

18. A continuous casting mold arrangement as set forth in claim 16, wherein said spring bands are arranged laterally of said beam means of said lifting table and said oscillation drive means is arranged below each of said beam means.

19. A continuous casting mold arrangement as set forth in claim 1, wherein said continuous casting mold is designed as a continuous casting plate mold comprising two parallel first side wall means and two second side wall means capable of being clamped between said first side wall means, and a clamping means adapted to clamp said second side wall means between said first side wall means, both of said second side wall means being supported on at least one of said first side wall means and on said beam means of said lifting table by said at least one of said first side wall means via its end portions.

20. A continuous casting mold arrangement as set forth in claim 19, further comprising plug connection means including a first connection part arranged on said lifting table and a first counter connection piece arranged on said first side wall means in its end regions for feeding said first side wall means and a second counter connection piece arranged on said cantilever beam means for feeding said second side wall means.

21. A continuous casting mold arrangement as set forth in claim 19, wherein said clamping means is formed by a tie connection means supported on both of said first side wall means.

22. A continuous casting mold arrangement as set forth in claim 21, wherein said tie connection means is comprised of a pressure medium cylinder.

23. A continuous casting mold arrangement as set forth in claim 19, further comprising a cantilever beam means provided on one of said first side wall means in at least one of its end regions, said cantilever beam means being adapted to carry a second side wall means.

24. A continuous casting mold arrangement as set forth in claim 23, wherein said cantilever beam means is provided on one of said first side wall means in both of its end regions, each of said cantilever beam means being adapted to carry a second side wall means and said one of said first side wall means being fixed on said lifting table as a fixed side wall.

25. A continuous casting mold arrangement as set forth in claim 23, further comprising position adjustment means provided on said cantilever beam means for said second side wall means.

26. A continuous casting mold arrangement as set forth in claim 23, wherein both of said first side wall means are guided on each other via said cantilever beam means.

27. A continuous casting mold arrangement as set forth in claim 26, further comprising contiguous guiding surface means provided both on said cantilever beam means and on said one of said first side wall means to be guided on said cantilever beam means, for guiding said cantilever beam means on said first side wall means.

* * * * *

UNITED STATES PATENT AND TRADEMARK OFFICE

CERTIFICATE OF CORRECTION

PATENT NO. : 5,505,249

DATED : April 9, 1996

INVENTOR(S) : Werner Scheurecker, Helmut Eidinger, Richard Kasmader, Josef Guttenbrunner It is certified that error appears in the above-indentified patent and that said Letters Patent is hereby corrected as shown below:

Column 9:

Claim 6,line 2, "7" should be --5--.

Signed and Sealed this

Sixteenth Day of July, 1996

*Attest:*

Bruce Lehman

BRUCE LEHMAN

*Attesting Officer*

*Commissioner of Patents and Trademarks*